United States Patent [19]

Imazu et al.

[11] 3,945,231

[45] Mar. 23, 1976

[54] PROCESS AND APPARATUS FOR PREPARATION OF THIN WALLED CYLINDRICAL VESSELS

[75] Inventors: Katsuhiro Imazu, Yokohama; Masao Miyata, Kawasaki, both of Japan

[73] Assignee: Toyo Seikan Kaisha Limited, Tokyo, Japan

[22] Filed: Oct. 29, 1974

[21] Appl. No.: 518,884

[30] Foreign Application Priority Data

Oct. 31, 1973 Japan ..... 48-121620
Sept. 18, 1974 Japan ..... 49-106786

[52] U.S. Cl. ..... 72/45; 72/349; 113/120 A
[51] Int. Cl.[2] ..... B21C 9/00; B21D 22/28
[58] Field of Search ..... 29/DIG. 46; 72/DIG. 20, 72/41, 43, 45, 56, 285, 348, 349; 113/120 A

[56] References Cited

UNITED STATES PATENTS

| | | | |
|---|---|---|---|
| 2,393,131 | 1/1946 | Vang | 72/DIG. 20 |
| 3,434,329 | 3/1969 | Goble | 72/DIG. 20 |
| 3,495,427 | 2/1970 | Balamuth | 72/DIG. 20 |
| 3,577,753 | 5/1971 | Shah et al. | 72/41 |
| 3,613,422 | 10/1971 | Kendall | 72/DIG. 20 |
| 3,657,910 | 4/1972 | Isobe et al. | 72/DIG. 20 |
| 3,774,426 | 11/1973 | Jezik et al. | 72/349 |
| 3,820,368 | 6/1974 | Fukuzuda et al. | 72/349 |

*Primary Examiner*—C. W. Lanham
*Assistant Examiner*—E. M. Combs
*Attorney, Agent, or Firm*—Diller, Brown, Ramik & Wight

[57] ABSTRACT

In preparing thin walled cylindrical containers, e.g., can bodies, by the drawing and ironing processing, the lubricating effect between the metal material and tool metal can be highly improved by irradiating ultrasonic waves at least to the part to be ironed of the side wall portion of a cup-like formed article simultaneously with application of a lubricant. With the improvement of the lubricating effect thus attained, the manufacturing rate of can bodies can be greatly increased without such troubles as breakages of the head portion, the ear edge portion and the bottom wall portion of the can body. This improvement of the lubricating effect can be further enhanced when ultrasonic waves are irradiated in the direction perpendicular to the tapered face of a tapered inlet portion of an ironing die.

19 Claims, 22 Drawing Figures

FIG. 3-A
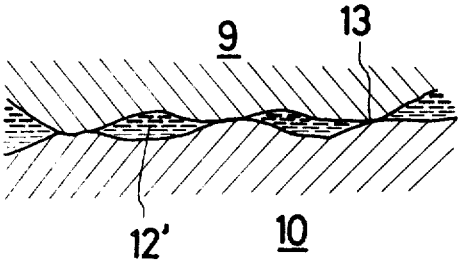
FIG. 3-B
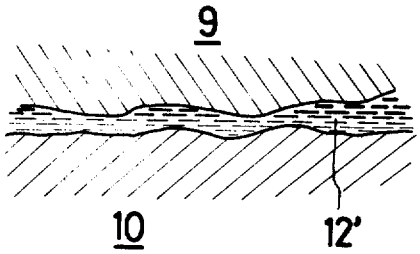
FIG. 4
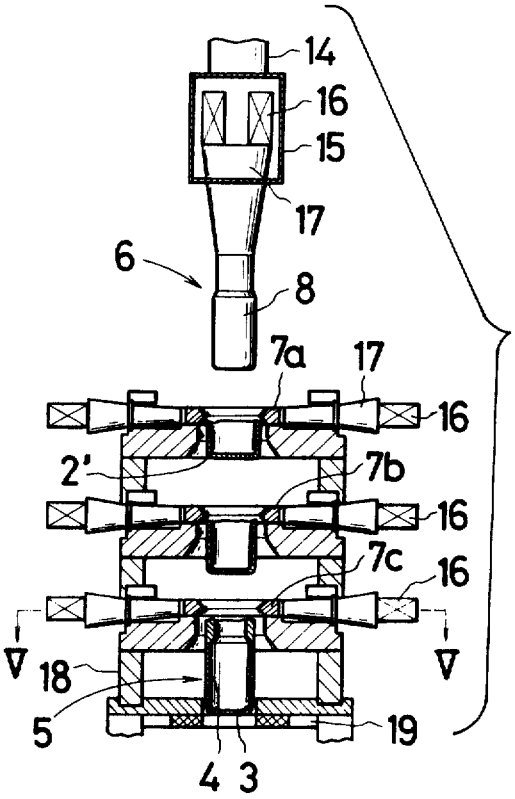
FIG. 5
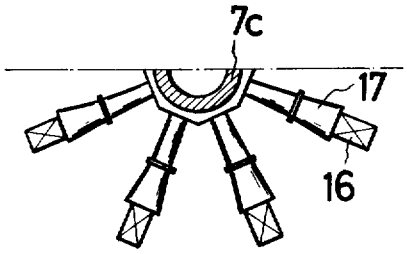

FIG. 7-A
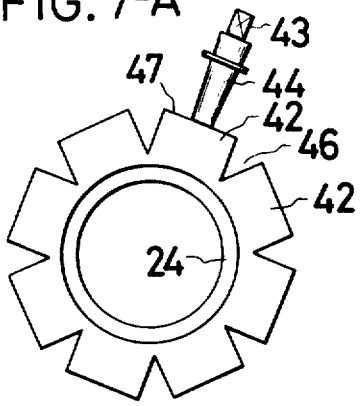
FIG. 7-D
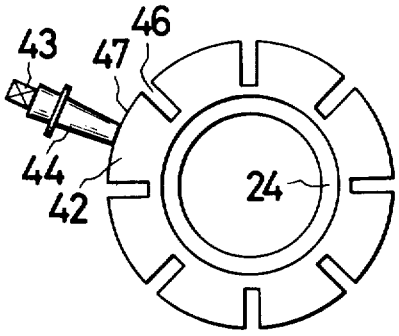
FIG. 7-B
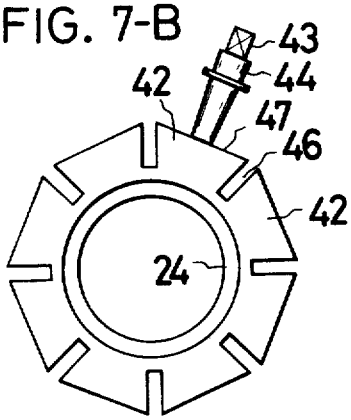
FIG. 7-E
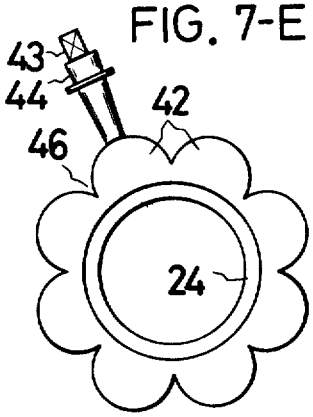
FIG. 7-C
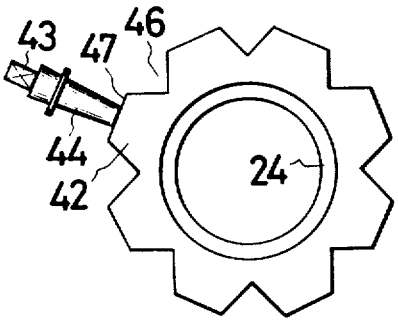
FIG. 7-F
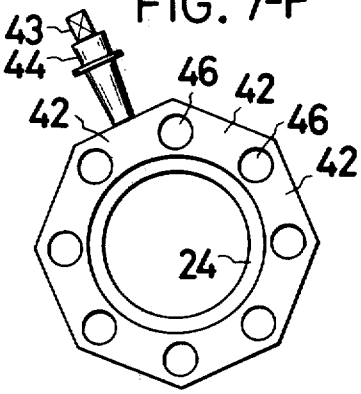

FIG. 8
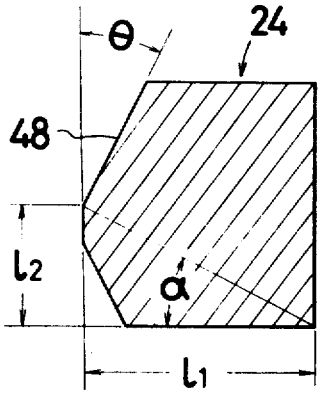
FIG. 9
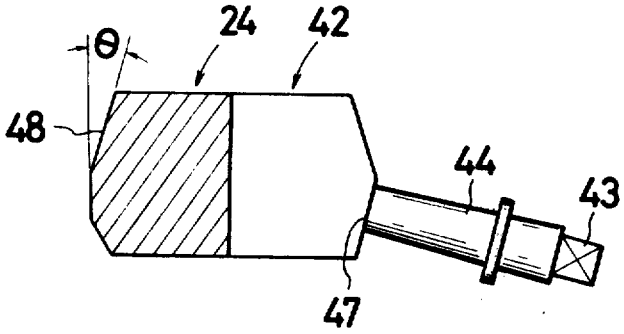
FIG. 10-A
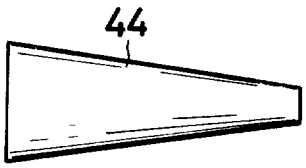
FIG. 10-B
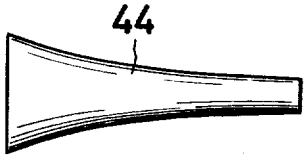
FIG. 10-C
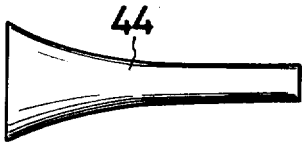
FIG. 10-D
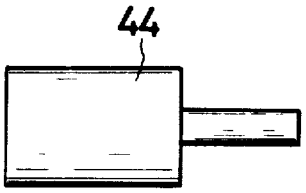

PROCESS AND APPARATUS FOR PREPARATION OF THIN WALLED CYLINDRICAL VESSELS

This invention relates to an improved process and apparatus for preparing thin walled cylindrical containers according to the drawing and ironing treatment. More particularly, the invention relates to a process for preparing thin walled containers according to the drawing and ironing treatment in which lubricating properties of portions to be ironed can be improved by utilizing ultrasonic vibration to thereby improve the working efficiency and various properties of this walled containers, and to an apparatus for practising this process.

It is known to prepare cylindrical containers (drawn and ironed cans) having a side wall portion of a relatively small thickness and a bottom of a relatively large thickness by a method comprising drawing a metal sheet blanked in the form of a disc or the like by means of a drawing punch and a drawing die to form a cup-like can body and ironing the side wall of the resulting cup-like can body between an ironing punch and an ironing die. In this known drawing and ironing forming method, the forming operation is generally accomplished by passing the punch carrying and supporting a cup-like can body thereon through the fixed ironing die. The lubrication (especially friction) between the metal material and tool at this step has a great influence on the working efficiency and properties of the resulting container.

In the conventional drawing and ironing forming method, good lubrication is accomplished by sparying a lubricating material to the zone where the metal sheet is ironed between the ironing die and punch, namely to the circumference of the ironing forming zone. According to this lubricating operation, however, it is very difficult to distribute the lubricating material uniformly between the tool and material, and therefore, there are brought about varous disadvantages causing reduction of the working efficiency. For instance, tools are readily worn by friction and a great processing force is required for exothermic molding.

The manufacturing cost of cylindrical containers by the drawing and ironing treatment is greatly influenced by the manufacturing rate per unit time, namely the time required for the ironing operation. In the above known forming method, however, such troubles as breakages of containers are readily caused when the operation is conducted at a high speed. Therefore, in the known forming method, it is necessary to perform the ironing operation at a low speed and in a multi-staged manner.

Moreover, according to the conventional method, it is very difficult to uniformalize the thickness of the side wall portion and the surface hardness in the resulting can body and hence, can bodies having good properties cannot be obtained. Still further, the conventional method is defective in that so called scratches are readily formed on the side wall portion of the can body.

We noticed that according to the conventional can body-forming method comprising ironing the side wall portion of a cylindrical container by the combination of an ironing punch and an ironing die in the presence of a lubricating material, it is difficult to form a uniform boundary lubricating interface between the metal material and ironing tool and hence, it is difficult to overcome the above-mentioned defects. As a result of our research works, we found that when the side wall portion is irradiated with ultrasonic waves at least at a part to be ironed while a lubricating material is fed to the ironing zone, a high lubricating effect can be attained and the above-mentioned defects involved in the conventional drawing and ironing method can be effectively overcome. It has also been found that when ultrasonic waves are irradiated from a plurality of ultrasonic wave-irradiating mechanisms disposed and distributed around the circumference of an ironing die, concentratedly on specific divided portions of the die circumference corresponding to respective ultrasonic wave-irradiating mechanisms in the direction substantially perpendicular to the inlet angle of the die, the most excellent effect can be attained.

It is therefore a primary object of this invention to prpvide a process and apparatus for preparing thin walled cylindrical containers by drawing and ironing a metal material, in which the lubricating property of the metal material at a portion to be ironed and formed can be highly improved by utilizing ultrasonic vibration, whereby the working efficiency of the forming operation and the manufacturing rate can be highly improved and simultaneously, properties of resulting thin walled cylindrical containers can also be improved.

Another object of this invention is to provide a process and apparatus for preparing thin walled cylindrical containers, in which the ironing forming operation can be accomplished under application of a much smaller processing force at a higher speed than in the conventional ironing forming method and thin walled cylindrical containers can be prepared with high productivity without such troubles as bottom breaking and the like.

Still another object of this invention is to provide a process and apparatus for preparing thin walled cylindrical containers, in which thin wall cylindrical containers having a relatively uniform thickness and a substantially uniform surface in the side wall portion and being substantially free of so called scratches on the outer surface can be prepared at a high manufacturing rate.

In accordance with this invention, there is provided a process for the preparation of thin walled cylindrical containers comprising subjecting a cup-like formed article composed of a metal material to the one-staged or multi-staged ironing processing between an ironing punch and an ironing die to elongate the side wall portion of the formed article and reduce the thickness of said side wall portion, wherein a lubricant is fed at least to the part to be ironed of the side wall portion and simultaneously, ultrasonic waves are irradiated at least on said part of the side wall portion.

In accordance with this invention, there is also provided a process for the preparation of thin walled cylindrical containers comprising subjecting a cup-like formed article composed of a metal material to the one-staged or multi-staged ironing processing between an ironing punch and an ironing die to elongate the side wall portion of the formed article and reduce the thickness of said side wall portion, wherein a lubricant is fed at least to the part to be ironed of the side wall portion and simultaneously, ultrasonic waves are irradiated from a plurality of ultrasonic wave-irradiating mechanisms disposed and distributed around the circumference of the ironing die concentratedly on specific fivided portions of the circumference of the die corresponding to respective ultrasonic wave-irradiating mechanisms in the direction substantially perpendicular to a tapered inlet portion of the die.

Still further, in accordance with this invention, there is provided an apparatus for the production of thin walled cylindrical containers which comprises an ironing punch for supporting a cup-like formed article composed of a metal material, at least one ironing die disposed circularly so that it surrounds the axis of the ironing punch and is engaged with the side wall portion of the cup-like formed article supported on the ironing punch, a driving mechanism for causing a relative reciprocal movement between said ironing punch and ironing die, and a lubricant feed mechanism disposed to feed a lubricant at least to the part to be ironed of the side wall portion of the cup-like formed article, wherein a plurality of ultrasonic wave-irradiating mechanism-supporting members are disposed equidistantly and substantially independently from one another on the outer periphery of said circular die, and a ultrasonic wave-irradiating mechanism comprising an assembly of a ultrasonic vibrator element and a horn is disposed on each of said ultrasonic wave-irradiating mechanism-supporting members so that the axis of the ultrasonic wave-irradiating mechanism is substantially perpendicular to a tapered inlet portion of said die.

This invention will now be illustrated in detail by reference to the accompanying drawing, in which:

FIGS. 1*a*–1*d* illustrate the sequence of steps in the process of this invention;

FIG. 2 is a sectional diagram illustrating an ironing apparatus, which is given for explanation of the ironing processing according to the conventional method;

FIG. 3-A is a schematic diagram illustrating in an enlarged manner the lubricating boundary interface between a metal material and an ironing tool;

FIG. 3-B is a schematic diagram illustrating in an enlarged manner the lubricating boundary interface between a metal material and an ironing tool;

FIG. 4 is a side view illustrating arrangement of main parts of an ironing apparatus to be used for practice of this invention;

FIG. 5 is a view taken along the line V—V of FIG. 4;

Figure 1A:
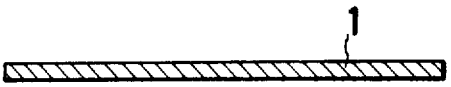
Figure 1B:
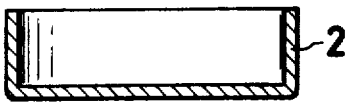
Figure 1C:
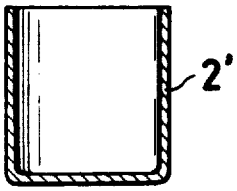
Figure 1D:
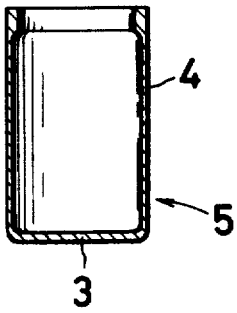

FIGS. 7-A to 7-F are views illustrating some instances of a ultrasonic wave-irradiating mechanism-supporting member to be used in the apparatus of this invention;

FIG. 8 is a view illustrating the section of an ironing die of the apparatus of this invention;

FIG. 9 is a sectional view showing the state of attachment of ultrasonic wave-irradiating mechanisms to the ironing die in the apparatus of this invention; and FIGS. 10-A to 10-D are side views showing some instances of a horn of the ultrasonic wave-irradiating mechanism of the apparatus of this invention.

Referring to FIG. 1 illustrating the step sequence in the process of this invention, at the first step (*a*), a metal material 1 is punched in an optional form such as a disc-like form (blanking step), and at the second step (*b*), the disc 1 is subjected to the first drawing to form the disc 1 into a shallow cup-like formed article 2 having a relatively large diameter. Then, at the third step (*c*), the cup-like formed article 2 is subjected to the redrawing to form the formed article 2 into a cup-like formed article 2′ having a relatively small diameter, and at the fourth step (*d*), the formed article 2′ is subjected to the ironing processing to iron the side wall portion of the cup-like formed article 2′ and form it into a seamless can body 5 comprising a can end portion 3 (can bottom portion) having a relatively large thickness and a side wall portion 4 having a relatively small thickness.

In the process of this invention, as the metal material 1 there can be employed, for example, a steel plate, a plate composed of a soft metal such as aluminum, and various plated and chemically treated steel plates such as a tin-plated sheet, a zinc-plated steel plate and a chromium-treated steel plate. In this invention, it is also possible to employ composite materials formed by coating these metal sheets or plates or applying resin layers such as resin film layers to these metal sheets or plates.

In this invention, because a specific combination of a lubricant and ultrasonic vibration is applied to the part to be ironed, it is made possible to form uncovered steel plates such as so called black plates. This results in great industrial and economical advantages.

These metal materials are available in the form of flat plates or coils, and they can be punched in the optional shape.

The thickness of the starting plate is varied depending on the use of the final product and the kind of the metal material, but it is generally preferred that the starting plate has a thickness of 0.2 to 0.6 mm. More specifically, it is preferred that the thickness of the starting plate is 0.25 to 0.4 mm in the case of a steel plate and 0.35 to 0.55 mm in the case of a plate of a light metal such as aluminum. The size of the unit metal material obtained by blanking is determined based on the calculated amount of the metal necessary for the final product.

Both the second drawing and third redrawing steps are performed under known conditions by using an ironing punch and an ironing die in combination. The draw ratio defined by the following formula:

$$\text{Draw Ratio } (Rd) = \frac{\text{Diameter } (D) \text{ of metal blank}}{\text{Diameter } (d) \text{ of drawing punch}}$$

is varied depending on the kind of the metal material and the material-preparing conditions. In general, it is preferred that a practical draw ratio of 1.89 to 1.67 in the case of aluminum or 2.22 to 1.82 in the case of a steel plate is adopted. In case it is difficult to obtain a cup-like formed article slip-fitting to the top end portion of the ironing punch by one-staged draw processing, a cup-like formed article formed by the first stage draw processing is subjected to the redraw processing, whereby a cup-like formed article suitably applicable to the process of this invention can be obtained. Incidentally, when this redraw processing is conducted, slight ironing (elongation — thickness reduction) is allowed at the redrawing step.

Figure 2:
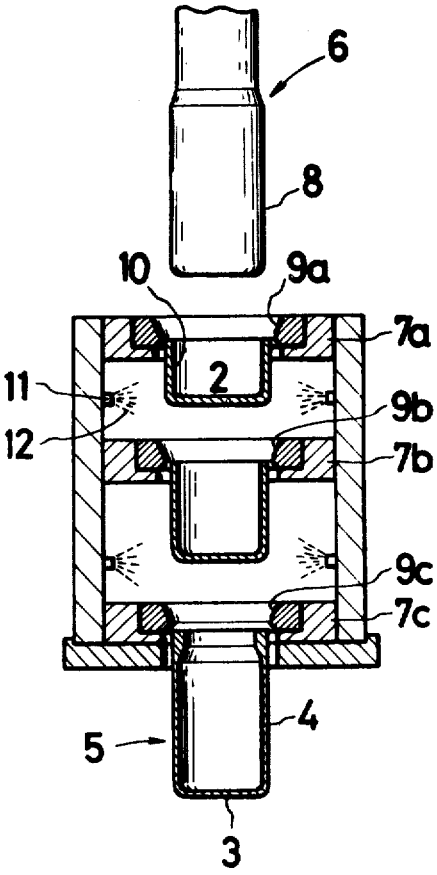

The so obtained cup-like formed article is then subjected to ironing forming. This ironing forming is accomplished by using an apparatus such as shown in FIG. 2. In FIG. 2, an ironing punch 6 and a plurality of ironing dies 7*a*, 7*b* and 7*c* coaxial with the ironing punch 6 are disposed so that they can move relatively with each other. The outer diameter of the acting surface 8 of the ironing punch 6 may be in agreement with the inner diameter of the side wall portion of the cup-like formed article (see FIG. 1) or may be smaller than the inner diameter of the side wall portion. The ironing dies 7*a*, 7*b* and 7*c* are so disposed that the clearance between the acting end point 9*a*, 9*b* or 9*c* of the die and the acting surface 8 of the ironing punch is smaller than the thickness ($t$) of the side wall portion of the cup-like formed article 2' and the clearance between the ironing punch and each die is gradually reduced with the movement of the ironing punch. The side wall 10 of the cup-like formed article 2' is ironed between the ironing punch 6 and the ironing die 7*a*, whereby the thickness of the side wall 10 is lessened and the side wall 10 is elongated. Then, the so thinned side wall portion is ironed between the next ironing die 7*b* and the ironing punch 6, and this ironing processing is continued until a desired residual thickness can be attained in the side wall portion.

In the conventional ironing formed method, a lubricant-projecting opening 11 is mounted above each die 7 to feed a lubricant between the side wall portion 10 of the cup to be ironed and the top end portion 9 of the die. According to such lubricating operation, however, it is difficult to distribute the lubricant uniformly between the top end portion of the die and the metal material to be processed. The reason is described below by reference to FIG. 3-A illustrating schematically the lubricating interface in the conventional ironing forming method in an enlarged manner. In the boundary area between a tool metal 9 and a metal material 10 being processed, there are present local lubricant-sealed portions 12' and portions 13 where the tool metal has a direct contact with the metal material, and under severe processing conditions such as ironing forming conditions, it is very difficult to develop the sealed liquid lubricant 12' uniformly throughout the boundary interface between both the metals. Accordingly, the conventional ironing forming method is still insufficient in the working efficiency and the resulting containers are defective in that the thickness or surface hardness is uneven and scratches (longitudinal strips) are formed on the surface.

One of important features of this invention is that when a side wall portion of a cup-like formed article is ironed between an ironing punch and an ironing die, a lubricant is fed to the part to be processed as mentioned above and ultrasonic waves are irradiated on said part. By irradiation of ultrasonic waves, a certain ultrasonic vibration is given between the tool and the metal material to be processed and the lubricant which is likely to be sealed in local portions of the interface between the tool metal and the metal material is sucked and distributed uniformly in said interface, so that the working efficiency in the ironing operation and the quality of the product can be highly improved. More specifically, in the ironing forming process of this invention, as shown in FIG. 3-B, it is made possible to distribute the liquid lubricant uniformly in the boundary interface between the tool metal 9 and the metal material 10, and hence, the region of the lubricating boundary interface can be enlarged as compared with the conventional ironing forming method and the area of the direct contact between both the metals can be reduced.

As illustrated above, according to this invention, by irradiation of ultrasonic waves on the part of a side wall portion of a cup-like formed article to be ironed, the following great advantages over the conventional ironing forming method can be attained:

1. The lubricating effect is improved between a tool and a metal material, and friction can be reduced between both the metals.

2. The processing time necessary for completion of ironing forming can be shortened and the producibility per unit apparatus can be improved.

3. Any of metal materials for can bodies can be ironed. For example, a metal material free of a soft metallic layer, e.g., a tin layer, such as a black plate, can be ironed effectively.

4. The life of tools can be prolonged very much.

5. The processing force necessary for the ironing operation can be drastically reduced and hence, a press having a relatively small capacity can be used.

6. The amount of ironing (amount of deformation) attainable by one ironing operation can be increased over the ironing amount attainable in the conventional method.

Various methods can be adopted in this invention for irradiation of ultrasonic waves on the part to be ironed. In general, it is preferred to adopt a method in which an ultrasonic vibrator element is attached to either or both of the ironing die and ironing punch and ultrasonic waves are irradiated on the part between the tool and metal material where the ironing processing is effected. For example, when a ultrasonic vibrator element is attached to the punch through a ultrasonic wave generator such as a horn, the ironing punch is vibrated vertically with a certain amplitude, and this vibration is transmitted to the side wall portion of the cup-like formed article to be ironed which is supported by the ironing punch. At this moment, the ironing punch absorbs the ultrasonic vibration energy and it is heated by this energy, but the temperature rise in the ironing punch by this absorption of the energy is much smaller than the temperature rise observed in the conventional ironing method and can be neglected. On the other hand, a plurality of ultrasonic vibrators and cones are mounted on the ironing die so that every two adjacent assemblies of the ultrasonic vibrator and cone are separated from each other with a certain angle in the peripheral direction, whereby ultrasonic vibrations of the same phase are given to the top end of the acting portion of the die. By these ultrasonic vibrations, a so called circular expansion and contraction movement is caused in the die. Namely, the die is expanded or contracted in the peripheral direction by these ultrasonic vibrations. Under these ultrasonic vibrations given to the metal material and/or the ironing die, the liquid lubricant fed between them is forcibly sucked in the interface therebetween without being locally sealed in narrow regions, to form a uniform boundary lubricating interface between the metal material and the ironing tool.

In the process of this invention, it is preferred that ultrasonic vibrators are attached to both the ironing punch and the ironing die. Referring to FIGS. 4 and 5 illustrating the main parts of the apparatus to be used for practice of the ironing forming process of this invention, a chamber 15 having a sufficient compression strength is mounted on a suitable part of a reciprocal movement shaft 14 having an ironing punch 6 disposed at the head thereof, and a ultrasonic vibrator element 16 and a cone 17 for transmitting ultrasonic vibrations to the punch 6 are diposed in the chamber 15. In each of a group of ironing dies 7*a*, 7*b* and 7*c* disposed equidistantly on a supporting stand 18 along the moving passage for the ironing punch, there are mounted a plurality of assemblies of a ultrasonic vibrator element 16 and a ultrasonic vibration-transmitting cone 17 so that every two adjacent assemblies are spaced from each other with a certain angle in the peripheral direction of the ironing die. This angle formed between two adjacent ultrasonic vibrators mounted around the prephery of the die is selected within a range of from 15° to 90°, but an angle of about 45° is generally preferred.

The frequency of the ultrasonic wave irradiated on the ironing punch and ironing die is selected within a range of 10 to 30 KHZ, especially 15 to 25 KHZ, appropriately depending on the kind of the metal material to be processed and the desired quantity of lubrication. The output power for irradiation of ultrasonic waves is not particularly critical, but it is generally preferred that the power is within a range of from 300 W to 1 KW, because a sufficient lubricating effect cannot be obtained at too small an output power and at too large an output power the energy is converted to an unnecessary heat, resulting in loss of the energy.

Feeding of a lubricant to the part of a cup-like formed article to be ironed can be accomplished by a known procedure. For example, a liquid lubricant is sprayed to the side wall portion of a cup-like formed article to be ironed or the part where ironing processing is performed. Any of known lubricant can be used in this invention. For example, one or more of lubricating components such as mineral oils, plant oils, polysiloxanes and polyolefins as they are or, is desired, in the state emulsified at a concentration of 20 to 60 % with water or a surface active agent. In this invention, even if the amount of the lubricant to be sprayed is substantially smaller than the amount of the lubricant used in the conventional method, a sufficient lubricating effect can be obtained.

A seamless cylindrical container 5 comprising a can bottom 3 having a relatively large thickness and a side wall portion 4 having a relatively small thickness, which has been formed by the above-mentioned ironing processing, is separated from the punch 6 during the return travel of the punch 6 by a suitable stripper disposed in the lower portion of a supporting stand 18 (see FIG. 4). In this invention, separation of the seamless container from the stripper can be performed more easily by irradiation of ultrasonic waves than in the conventional method. The cylindrical container, which has thus been subjected to the ironing forming operation, is then subjected to such processing as dooming, necking-in and flanging to obtain a final can body.

In accordance with a preferred embodiment of this invention, a plurality of ultrasonic wave-irradiating mechanisms are disposed and distributed around the circumference of an ironing die and ultrasonic waves are irradiated concentratedly on specific divided portions of the circumference of the die corresponding to respective ultrasonic wave-irradiating mechanisms in the direction substantially perpendicular to a tapered inlet of the die. By this arrangement, a sufficient lubricating effect can be attained with the ultrasonic wave-irradiating mechanism of a small output power and generation of heat in the ironing tool and metal material by irradiation of ultrasonic waves can be controlled at a very low level. Only when a plurality of ultrasonic wave-irradiating mechanisms are disposed around the circumference of the ironing die, ultrasonic wave-irradiating mechanisms of a considerably large output power should inevitably be used for imparting sufficient vibrations to the ironing die and improving the lubricating effect, and when such large output power ultrasonic wave-irradiating mechanisms are employed, generation of heat is conspicuous in the ironing die. In contrast, when a plularity of ultrasonic wave-irradiating mechanisms are equidistantly disposed along the circumference of the ironing die and ultrasonic waves are irradiated from them concentratedly on specific divided portions of the circumference of the die corresponding to respective ultrasonic wave-irradiating mechanisms, the ultrasonic output power can be utilized most effectively for distributing and forming a layer of the lubricant throughout the interface area between the tool metal and metal material and generation of heat in the ironing die by irradiation of ultrasonic waves can be controlled and maintained at a very low level. In this preferred embodiment of this invention, also the direction of ultrasonic waves to the ironing die is important. The ironing die has a tapered inlet portion which is gradually tapered in the axial direction of the ironing die, namely in the direction of movement of the ironing punch, and this tapered portion is engaged with the metal material supported on the ironing punch to effect forcible drawing of the metal material. In this preferred embodiment of this invention, ultrasonic waves are irradiated in the direction substantially perpendicular to the tapered inlet portion of the ironing die, so that the improvement of the lubricating effect by irradiation of ultrasonic waves can be highly enhanced. When ultrasonic waves are irradiated in other directions, for example, in the direction in parallel with the inclined face of the tapered inlet portion, no conspicuous improvement of the lubricating effect can be expected (see Run 4 of Example 4).

According to the above-mentioned preferred embodiment of this invention, the following advantages can be attained by adoption of the above specific irradiation system in addition to the above-mentioned advantages (1) to (6);

7. A further improvement of the lubricating effect between the tool and the metal material can be expected by elevation of the ultrasonic irradiation efficiency, and hence, the above advantages (2) to (6) can be enhanced conspicuously.

8. A sufficient lubricating effect can be attained by using ultrasonic wave-irradiating mechanisms of a relatively low output power.

9. Generation of heat in the tools and the like by irradiation of ultrasonic waves can be controlled and maintained at a relatively low level.

In this preferred embodiment, in order to perform irradiation of ultrasonic waves according to the above specific system, it is preferred that ultrasonic wave-irradiating mechanism-supporting members are equidistantly disposed separately from one another along the outer periphery of a circular ironing die known per se, and that a ultrasonic wave-irradiating mechanism comprising an assembly of a ultrasonic vibrator and a horn is mounted on each of these supporting members.

Figure 6:
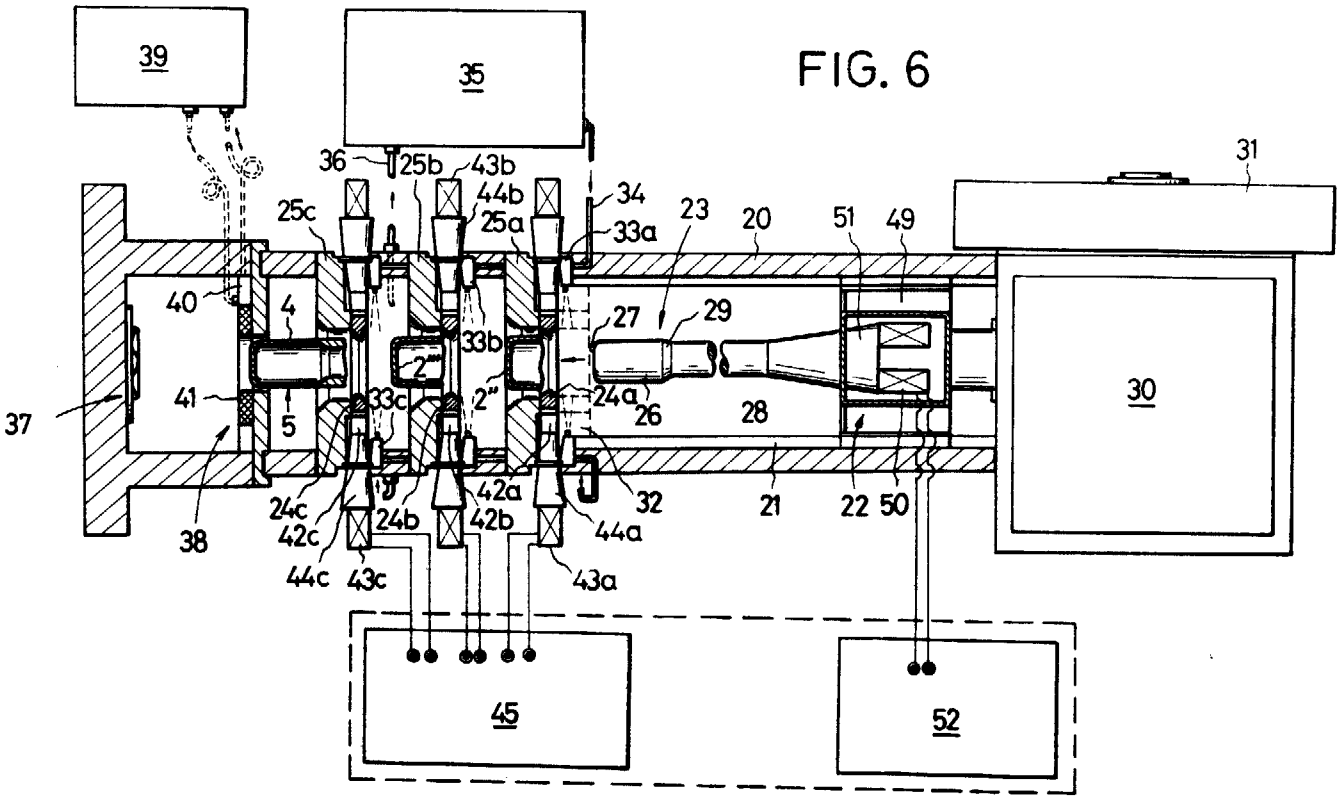
FIG. 6 is an arrangement view of an embodiment of the apparatus of this invention.

Referring to FIG. 6 illustrating the entire arrangement of the apparatus suitable for practising the process of this invention, two facing guide rails 21 are disposed to extend in the longitudinal direction of a machine frame 20, and an ironing punch-supporting stand 22 is mounted so that it can move reciprocally on these guide rails. An ironing punch 23 is fixed to this supporting stand 22. A plurality of circular ironing dies 24*a*, 24*b* and 24*c* are attached to the machine frame 20 through ironing die-supporting members (die back-up plates) 25*a*, 25*b* and 25*c* to surround the axis of the ironing punch 23.

The ironing punch 23 comprises an outer peripheral surface 26 having a slip-fitting engagement with the inner face of the side wall portion of a cup-like formed article (not shown), a head portion 27 supporting the bottom wall of the cup-like formed article, and a shoulder 29 for forming a flange portion of the container in a part connecting the outer peripheral surface to the ironing punch shaft 28.

A suitable driving mechanism 30 is mounted on one end portion of the machine frame 20 to move the ironing punch stand 22 reciprocally in the longitudinal direction of the machine frame 20, namely in the axial direction of the ironing punch 23. Any of mechanisms capable of causing a reciprocal movement of a constant stroke length to the ironing punch stand and hence, to the ironing punch can be used as the driving mechanism 30. For example, it is possible to use an optional mechanism for converting a rotary movement to a linear reciprocal movement such as cam and crank mechanisms driven by a driving pulley, gear or sprocket 31, or a driving mechanism including a fluid cylinder such as a hydraulic cylinder.

A plurality of the above-mentioned circular ironing dies 24 (hereinafter alphabetic symbols *a*, *b* and *c* are omitted unless the specific circular die is mentioned) are disposed so that they have an axial line in agreement with the axial line of the ironing punch 23 making a reciprocal movement and a certain clearance from the outer peripheral surface 26 of the ironing punch. Further, these circular ironing dies 24*a*, 24*b* and 24*c* are located equidistantly in the axial direction so that the clearance between the die and punch is gradually reduced. By adoption of such arrangement, the side wall portion (not shown) of the cup-like formed article supported on the acting side face 26 of the ironing punch can undergo the multi-staged ironing processing.

A cup-like formed article 2 or 2' (see FIG. 1) formed at the drawing step or redrawing step is fed between the ironing punch 23 and ironing die 24, and for accomplishing this feeding, a cup-like formed article-supporting stand 32 is mounted on the approach side of the first ironing die 24*a*. This supporting stand 32 is provided with a compression mechanism (not shown) utilizing a fluid, such as air cylinder, and a retaining mechanism (not shown) actuated by this compression mechanism, and the supporting stand 32 has activites of positioning a cup-like formed article fed from a suitable feed device (not shown) correctly on the axis of the ironing punch 23 and of establishing a slip-fitting engagement between the side wall portion of the cup-like formed article and the side face portion 28 of the ironing punch inititating the movement for the ironing processing.

A plurality of lubricant feed nozzles 33*a*, 33*b* and 33*c* are disposed on introduction sides of corresponding circular ironing dies 24*a*, 24*b* and 24*c*, respectively, to feed a lubricant between the cup-like formed article making the movement for the ironing processing in the state supported on the ironing punch 23 and each of the circular dies 24. Each of lubricant feed nozzles 33*a*, 33*b* and 33*c* is connected to a lubricant feed device 35 through a conduit 34 for feeding of a lubricant. The excessive lubricant stored in the ironing apparatus is recycled to the lubricant feed device 35 through a return conduit 36. It is possible to attach a cooling device (not shown) to the lubricant feed device 35 for cooling a lubricant used and maintaining it at a suitable temperature.

In the apparatus of this invention shown in FIG. 6, a doom-forming member 37 is mounted on the axis of the ironing punch 23 in the machine frame 20. This doom-forming member 37 is disposed to beat the bottom of the cup-like formed article supported by the ironing punch 23. As shown in FIG. 6, the doom-forming member 37 has a shoulder on the peripheral portion and a doom-like swollen portion at the central part thereof. In the apparatus shown in FIG. 6, at the point of termination of the movement of the ironing punch 23 for the ironing processing, beating of the bottom of the ironed container is performed by this doom-forming member 37.

On termination of this movement for the ironing processing, the return travel of the ironing punch 23 is initiated, and during this return travel, a thin walled cylindrical container formed by the above ironing forming is separated from the ironing punch 23. For attainment of this separation, a cylindrical container stripper 38 is mounted on the machine frame 20 on the discharge side of the final ironing die 25*c* along the plane including the outer peripheral face 26 of the ironing punch 26. This cylindrical container stripper 38 comprises an air cylinder 40 actuated by compressed air fed from a compressed air feed device 39 and a holding mechanism 41 actuated by the air cylinder 40 to hold the ear edge portion of the cylindrical container on the ironing punch, namely the open side edge portion of the cylindrical container. A thin walled cylindrical container formed by the ironing processing is separated from the punch 23 by means of this stripper 38.

The most important feature of the apparatus of this invention is that a plurality of substantially independent ultrasonic wave-irradiating mechanism-supporting members 42 are equidistantly disposed on the outer periphery of each circular ironing die and a ultrasonic wave-irradiating mechanism comprising an assembly of a ultrasonic vibrator element 43 and a horn 44 is mounted on each supporting member 42. A ultrasonic vibrator 45 is disposed outside the machine frame to feed an electric ultrasonic power to ultrasonic vibrator elements 43*a*, 43*b* and 43*c* attached to circular ironing dies 24*a*, 24*b* and 24*c*, respectively, and ultrasonic waves from the ultrasonic vibrator elements 43*a*, 43*b* and 43*c* are transmitted and irradiated on the corresponding circular ironing dies 24*a*, 24*b* and 24*c* through respective cones 44*a*, 44*b* and 44*c* and supporting members 42*a*, 42*b* and 42*c*.

In this invention, in order to enhance the ultrasonic irradiation efficiency, it is important that a plurality of ultrasonic wave-irradiating mechanism-supporting members 42 are disposed equidistantly and substantially independently from one another along the outer periphery of each circular ironing die.

Referring to FIGS. 7-A and 7-F illustrating some instances of the ultrasonic wave-supporting member, a member for supporting a ultrasonic wave-irradiating mechanism comprising an assembly of a ultrasonic vibrator element 43 and a cone 44 (horn) includes a number of projections 42 mounted on the circumference of the ironing die 24 via void portions 46 such as notches or holes, and a ultrasonic wave-irradiating mechanism is attached to each of the projections 42 (in FIGS. 7-A to 7-F, for simplicity a ultrasonic wave-irradiating mechanism is shown only on one of the projections). These projections 42 acting as ultrasonic wave-irradiating mechanism-supporting members can take an optional form, as far as they satisfy the condition that they should be disposed around the circumference of the circular ironing die 24 independently from one another, and hence, the voids 46 located between every two adjacent projections can take an optional form.

For example, in FIG. 7-A, the projection 42 acting as the ultrasonic wave-irradiating mechanism-supporting member has a form of a rectangular parallelepiped projecting outwardly from the circumference of the die, and triangular notches 46 are present between every two adjacent projections 42. This projection 42 may have a reverse trapezoid form as shown in FIG. 7-B or a trapezoid form as shown in FIG. 7-B. In FIGS. 7-A to 7-C, the top face 47 of the projection 42, namely the ultrasonic wave-irradiating mechanism-supporting face, is a plane surface. This supporting face 47 may be a curved surface, for example, a surface of a part of the circumference as shown in FIG. 7-D. In FIG. 7-D, projections 42 are formed by providing slit-like notches 45 on a disc in the radial direction thereof. Further, as shown in FIG. 7-E, the projection 42 acting as the ultrasonic wave-irradiating mechanism-supporting member may have a configuration of a cycloid curve such as an involute curve. Moreover, the projection 42 may have a configuration of a quadratic curve such as a circle, an ellipse and a hyperbola, a combination of these quadratic curves, a combination of such quarratic curve with a straight line, or the like. Ultrasonic wave-irradiating mechanism-supporting members shown in FIGS. 7-A to 7-E are formed by forming notches 46 and projections 42 alternately and equidistantly on a disc or a polygonal plate. It is also possible to form ultrasonic wave-irradiating mechanism-supporting members 42 substantially indpendent from one another by perforating holes 46' equidistantly on a disc or polygonal plate.

In the above-mentioned preferred embodiment of this invention, it is desired that the circumferential angle between the two adjacent ultrasonic vibrator elements disposed around the circular die 24, namely the angle approxinating between the two adjacent ultrasonic wave-irradiating mechanism-supporting members 42, is selected within a range of from 15° to 90°, especially 30° to 45°. In other words, it is desired that 4 to 24, especially 8 to 12, of supporting members (projections 42) and corresponding ultrasonic wave-irradiating mechanisms are disposed around the circular die. Further, good results are obtained when the ratio of the size *b* in the radial direction of the void portion such as a notch or hole to the size *a* projection in the radial direction of the ultrasonic wave-irradiating mechanism-supporting member 42 attached around the outer periphery of the circular die, namely the ratio *b/a*, is within a range of from 0 to 1, especially from 0.60 to 0.85. When the above ratio is greater than 0.85, it is difficult to attain the primary object of this invention, namely the object of improving the lubricating effect based on ultrasonic vibration by irradiating ultrasonic waves from ultrasonic wave-irradiating mechanisms 43, 44 disposed and distributed around the circumference of the circular die 24 concentratedly on specific divided regions of the circular die corresponding to the ultrasonic wave-irradiating mechanisms.

In the preferred embodiment of this invention, also the angle of attachment of the ultrasonic wave-irradiating mechanisms 43, 44 to the circular die 24 is important. Referring to FIG. 8 showing the section in the radial direction of the circular die 24 is an enlarged manner, the circular ironing die 24 to be used in this invention has a tapered inlet portion 48 on the introduction side thereof, and the ironing processing is accomplished by engagement of this tapered portion 48 with the side wall portion of the cup-like formed article supported on the side face of the ironing punch. The angle $\theta$ of the tapered inlet portion 48 to the movement direction of the ironing punch (the vertical direction in FIG. 8) is varied depending on the ironing ratio attained by one ironing processing, but it is generally within a range of from 5° to 20°, preferably from 7° to 10°. In the preferred embodiment of this invention, ultrasonic waves are irradiated in the direction substantially perpendicular to the tapered inlet portion 48 of the circular ironing die. It is at this tapered inlet portion 48 that the greatest friction occurs between the metal material and tool metal in preparing thin walled cylindrical containers by the ironing forming. We found that when ultrasonic waves are irradiated in the direction substantially perpendicular to this tapered inlet portion 48, the highest improvement of the lubricating effect is attained between the metal material and tool metal. For attaining this feature, it is preferred that in the ironing die shown in Fig. 8, which is used in the apparatus of this invention, the angle $\alpha$ defined by the following formula $$\tan \alpha = l_2/l_1$$

wherein $l_1$ is the size in the radial direction of the ironing die 24 and $l_2$ is the distance between the minimum diameter portion (tip) of the tapered inlet portion 48 and the discharge side of the ironing die, is substantially equal to the taper angle $\theta$ of the tapered inlet portion 48.

It is also important that as shown in FIG. 9, the supporting face 47 of the ultrasonic wave-irradiating mechanism-supporting member 42 is attached to the circular ironing die 24 is inclined substantially in parallel with the tapered inlet portion 48 of the die and the axis of the ultrasonic wave-irradiating mechanisms 43, 44 is substantially perpendicular to the axis of the tapered inlet portion 48. According to this invention, ultrasonic waves are irradiated on the circular ironing die from the ultrasonic wave-irradiating mechanisms arranged in the above-mentioned specific manner, whereby it is made possible to apply ultrasonic vibrations to the tapered inlet portion of the ironing die undergoing the severest friction while maintaining the loss of the ultrasonic vibrations in the die at a very low level, and a maximum elongation and contraction movement in the circumferential direction can be caused in the tapered inlet portion of the ironing die. Furthermore, it is made possible to introduce the lubricant, which is fed between the tapered inlet portion of the ironing die and the metal material, uniformly into the interface between them without sealing or confining the lubricant in narrow specific areas of the interface.

Known mechanisms can be used as a ultrasonic wave-irradiating mechanism comprising assembly of a ultrasonic vibrator element and a horn (cone). For example, there are known a conical horn as shown in FIG. 10-A, an exponential horn as shown in FIG. 10-B, a catenary horn as shown in FIG. 10-C and a stepped horn as shown in FIG. 1-D. Any of these known horns can be used in this invention as the horn 44 of the ultrasonic wave-irradiating mechanism. In these horns, the amplitude magnifying ratio is greater in an order of the conical horn, the exponential horn, caternary horn and the stepped horn, and the ultrasonic processing area is greater in an order reverse to the above. In the ironing forming process of this invention, since the processing area is relatively small, it is preferred that a conical horn or exponential horn is selected among these known horns and is used.

Referring again to FIG. 6, in the apparatus of this invention, in many cases a sufficient improvement of the lubricating effect can be attained only by mounting ultrasonic wave-irradiating mechanisms 43, 44 on each of the ironing dies 24*a*, 24*b* and 24*c*. If desired, it is possible to irradiate ultrasonic waves also on the ironing punch supporting the cup-line formed article. For example, as shown in FIG. 6, a chamber 49 for holding a ultrasonic wave-irradiating mechanism is mounted in the interior of the ironing punch-supporting stand 22, and an assembly comprising a ultrasonic vibrator element 50 and a horn 51 (inclusive of a cone) is contained in this chamber 49. The axis of the horn 51 (inclusive of a cone) is in agreement with the axis of the punch 23. An electric power from a ultrasonic vibrator 52 disposed outside the machine frame is converted to ultrasonic vibration by the ultrasonic vibrator element 50 and is transmitted via the horn 51 (inclusive of a cone) into the axial direction of the ironing punch, namely in the direction of the side wall portion of the cup-like formed article being processed.

The preparation of thin walled cylindrical containers by the apparatus shown in FIG. 6 is performed in the following manner.

A cup-like formed article formed at the drawing or redrawing step illustrated by referring to FIG. 1 is fed to the position of a cup-like formed article-supporting stand 32 by means of a suitable feed device. At this point, an air cylinder (not shown) is actuated by compression of air fed from a suitable air feed source (not shown), and the cup-like formed article is set at a correct position for receiving the ironing punch 23 therein by means of a clamping member (not shown).

At this moment, an ironing punch-supporting stand 49 is set at the position for initiation of the ironing movement, namely at the most right position in FIG. 6. A driving pulley 31 is driven by a suitable power system (not shown) and by converting the rotary movement of the pulley 31 to a linear movement by a driving member 30, the ironing punch-supporting stand 22 starts the ironing movement in the left direction along guide rails 21.

The ironing punch 23 is inserted into the interior of the cup-like formed article held by the supporting stand 32, and on releasing the air pressure of the air cylinder (not shown) of the supporting stand 32 at this point, the cup-like formed article is supported by the head 27 of the ironing punch 23 and the outer peripheral surface 26 of the ironing punch 23 and is moved together with the ironing punch 23.

The cup-like formed article being moved in the state supported by the ironing punch 23 falls in engagement with a first ironing die 24*a* to subject the side wall portion of the cup-like formed article to the first ironing processing. According to this invention, a lubricant is fed to the part to be processed of the side wall portion of the cup-like formed article and simultaneously, ultrasonic waves are irradiated on the part to be processed. In FIG. 6, a lubricant is fed to a first-stage lubricant feed nozzle 33*a* disposed on the introduction side of the first ironing die 24*a* from a lubricant feed device 35 through a conduit 33*a*, and the liquid lubricant is applied to the surface of the cup-like formed article just before entrance into the first ironing die 24*a*. Any of lubricant mentioned with respect to the embodiment shown in FIGS. 4 and 5 can be used.

In the ironing processing of the side wall portion of the cup-like formed article, an electric power from a ultrasonic vibrator 45 is applied to ultrasonic vibrator elements distributed along the circumference of the circular die 24*a*, and ultrasonic vibrations of the same phase are transmitted to the circular die 24*a* through the cone 44*a* and ultrasonic wave-irradiating mechanism-supporting member 42*a* in the above-mentioned specific manner. If desired, it is possible to apply an electric power from a ultrasonic vibrator 52 to a ultrasonic vibrator element 50 held in a chamber 49 of an ironing punch-supporting stand 22 and transmit resulting ultrasonic vibrations to the side wall portion of the cup-like formed article through a cone 51 and an ironing punch 23.

The frequency of the ultrasonic vibration is experimentally decided and selected within a range of from 10 to 30 KHZ, especially from 15 to 25 KHZ, appropriately depending on the kind of the metal material to be processed and the desired quantity of lubrication. The power of the ultrasonic vibration to be irradiated on the ironing die 24 is not particularly critical but it is generally preferred that a power of 300 to 1000 W, especially 300 to 500 W, is applied per ironing die, because no substantial improvement of the lubricating effect can be attained at too small a power and because at too large a power the vibration is converted to heat and loss of the energy is brought about. In the above-mentioned preferred embodiment of this invention, ultrasonic waves are irradiated on the ironing die substantially perpendicular to the tapered inlet portion of the ironing die through a plurality of ultrasonic wave-irradiating mechanism-supporting members disposed around the ironing die independently from one another, so that at a relatively small ultrasonic output power such as 500 W or lower a sufficient improvement of the lubricating effect can be obtained. In this invention, irradiation of ultrasonic waves on the ironing punch 23 is optional, but when it is intended to enhance the improvement of the lubricating effect, it is preferred to apply a ultrasonic power of 500 to 1000 W to the ironing punch 23.

In the apparatus shown in FIG. 6, since the clearance between the top end of the acting portion of the first ironing die 24*a* and the outer peripheral face 26 of the ironing punch is smaller than the thickness of the side wall portion of the cup-like formed article, the side wall portion of the cup-like formed article falls in engagement with the tapered inlet portion 48 (see FIGS. 4 and 5) of the ironing die 24*a* under irradiation of ultrasonic waves through a uniform interface of the lubricant, and the metal of the side wall portion is elongated in the movement direction of the ironing punch, namely in the axial direction of the cup-like formed article. In this manner, the cup-like formed article undergoes the first ironing processing. Then, a lubricant is applied to the cup-like formed article 2'', which has been subjected to the first ironing processing, from a lubricant feed nozzle 33*b*, and the cup-like formed article 2'' is ironed under irradiation of ultrasonic waves transmitted from ultrasonic wave-irradiating mechanisms 43*b*, 44*b* by engagement with a second ironing die 24*b*. In this manner, the cup-like formed article undergoes the second ironing processing. In the same manner as described above, the cup-like formed article 2''', which has been subjected to the second ironing processing, is ironed by engagement with a final ironing die 24c, and the intended thin walled cylindrical container is obtained.

In this invention, the value of the ironing ratio defined by the following formula $$\text{ironing ratio} = \frac{\text{plate thickness before ironing-plate thickness after ironing}}{\text{plate thickness before ironing}} \times 100$$

can be maintained at a relatively high level, for example, 20 to 60%, especially 30 to 50%, per ironing processing, and the overall ironing ratio can be maintained within a range of 60 to 85%, especially 65 to 80%, though these values vary to some extent depending on the kind of the metal material to be processed. In this invention, even when the ironing ratio per stage of the ironing processing is higher than 30% and the overall ironing ratio is higher than 70%, by adoption of the above-mentioned ultrasonic wave-irradiating system, thin walled cylindrical containers free of scratches can be prepared without such troubles as breaking of the bottom and breaking of the upper ear edge. In the multi-staged ironing processing using a plurality of circular ironing dies, it is generally preferred that the number of stages is from 2 to about 4, and good results can usually be obtained by the three-staged ironing operation such as shown in FIG. 6. Optimum values of the ironing ratio per stage of the ironing and the overall ironing ratio in various metal materials are as shown in Table 1.

Table 1

| Metal Material | Ironing Ratio (%) | |
|---|---|---|
| | per stage of ironing | overall |
| Aluminum (soft) | 40 - 48 | 64 - 82 |
| Aluminum (hard) | 34 - 46 | 64 - 78 |
| Tin-plated steel plate (bright) | 35 - 45 | 62 - 75 |
| Tin-plated steel plate (matted) | 38 - 48 | 62 - 78 |
| Black plate | 25 - 45 | 56 - 70 |

In the apparatus shown in FIG. 6, a thin walled cylindrical container 5, the side wall portion of which has thus been ironed, is further moved to the left in the state supported by the ironing punch 23, and the bottom of the thin walled cylindrical container 5 is beaten into a doom form by means of a dooming portion 37.

In case a flange portion having a relatively great thickness is formed at the upper ear edge of the cylindrical container in the apparatus shown in FIG. 6, it is preferred that the side wall portion of the cup-like formed article is developed to the shoulder 29 of the punch 23 at the final ironing step.

Then, with rotation of the driving pulley 31, the driving portion 30 causes the ironing punch-supporting stand 22 to begin the return movement in the right direction. At this point, a stripper 38 for thin walled cylindrical containers is actuated by air pressure fed from a compressed air feed from a compressed air feed device 39 to hold a thin walled cylindrical container which has been formed by the above-mentioned ironing forming and dooming operations and separate the container from the ironing punch 23. If at this point ultrasonic waves are irradiated on the ironing punch 23 according to the preferred embodiment of this invention, separation of the thin walled cylindrical container can be done more easily than in the conventional method. Then, the ironing punch-supporting stand 22 is returned to the position for initiation of the ironing movement, and the above-mentioned procedures are repeated.

In this invention the stroke number of the ironing punch 23 can be changed within a considerably broad range, but in view of elevation of the manufacturing rate and uniformalization of the thickness of the side wall portion of the container, it is preferred that the stroke number is 60 to 150 per minute, especially 100 to 130 per minute. In the conventional ironing forming method, it is generally difficult to increase the stroke number over 120 per minute. In contrast, if the specific ultrasonic wave-irradiating system is adopted according to this invention, it is made possible to produce can bodies at such a high speed as a stroke number exceeding 120 per minute.

In this invention, thin wall cylindrical containers formed by the above-mentioned apparatus are subjected to the necking-in and flanging treatments using known means to obtain final can bodies.

When the ironing processing is conducted by irradiating ultrasonic waves on the part to be processed by the specific means according to the process of this invention, in addition to the above-mentioned conspicuous improvement of the lubricating effect the following advantages can be attained in connection with properties of the metal material and the processed product.

i. By performing irradiation of ultrasonic waves in a manner most effective for a metal material to be processed, the yield stress can be reduced in any of metal materials, so that the processing force can be reduced most effectively and occurrence of troubles such as breakage of the metal material can be prevented during the forming operation.

ii. The surface hardness of a container which has been ironed under irradiation of ultrasonic waves according to the process of this invention is substantially uniform and the work hardening is generally maintained at a low level. Accordingly, it will readily be understood that the residual stress is very low in the formed container.

iii. By application of ultrasonic vibrations, the lubricating effect is highly improved, and simultaneously, the action of discharging foreign materials is attained. Accordingly, dusts or metal powders sticking to the vicinity of the inlet of the die or the surface of the metal material are automatically cleaned away and discharged and as a result, formation of scratches, voids and scars by intrusion of metal powders or the like can be much reduced as compared with the conventional method and the surface finish (metallic luster and surface smoothness) can be highly improved.

iv. Since the processing force can be reduced, occurrence of such undesired phenomena as the variation of the wall thickness and non-uniformity of the plate thickness can be much reduced.

Various modifications can be made to the process and apparatus of this invention as far as they do not deviate from the spirit of this invention. For example, though according to the ultrasonic wave-irradiating system of this invention generation of heat can be maintained at a very low level in the ironing apparatus because the friction is reduced and the efficiency of utilization of the ultrasonic vibration can be heightened, it is possible to form voids in the interior of the ironing punch 23 and pass a cooling medium through them according to need, to thereby effect positive cooling.

This invention will now be illustrated in more detail by reference to the following Examples that by no means limit the scope of the invention.

EXAMPLE 1

A bright tin-plated steel plate material formed by continuous casting; tin coating on the surface being 1.00 lb per base box) having a thickness of 0.32 mm was blanked into discs having a diameter of about 142 mm, and they were formed into cup-like articles having an inner diameter of about 65 mm between a drawing punch and a drawing die according to customary procedures.

Then, cup-like formed articles were ironed by using ironing punches and ironing dies provided with ultrasonic vibrator elements shown in FIGS. 4 and 5. The ironing ratio by each ironing die was set as follows:

| Ironing Die | Ironing Ratio |
|---|---|
| first | 18 % |
| second | 30 % |
| third | 41 % |
| total (overall ironing ratio) | 66.3 % |

The lubricating operation was performed by spraying a lubricant having the following composition to cup-like formed articles to be processed from lubricant spray nozzles provided above respective dies. Composition of Lubricant:

| | |
|---|---|
| Mineral oil | 3 parts |
| Surface active agent | 1 part |
| Water | 6 parts |

The frequency of the ultrasonic wave irradiated on the ironing punch was 20 KHZ and its power was 500 W, and the frequency of the ultrasonic wave irradiated on the ironing die was 15 to 20 KHZ and the total power of the ultrasonic wave applied to all of ironing dies (8 dies) was 500 W. The number of strokes of the ironing punch per minute, namely the rate of preparing ironed can bodies per minute, was 150 per minute.

Various dimensions of seamless cans prepared by the above drawing and ironing, the average surface hardness (HR 30I and HV 500 g) of the side wall portion, the standard deviation of the surface hardness, the appearance of the surface of the side wall portion and the surface smoothness of the side wall portion (maximum height roughness Hmax) were determined, and these properties were compared with those of seamless cans prepared in the same manner as described above except that no ultrasonic wave was irradiated. Results are shown in Table 2.

Table 2

| | Ultrasonic Wave-Irradiated Cans | Non-Irradiated Cans |
|---|---|---|
| Inner Diameter (mm) | 65.30 | 65.30 |
| Height (mm) | 122 | 122 − 123 |
| Thickness (mm) of Side Wall Portion | 0.10 ± 0.02 | 0.10 ± 0.05 |
| Average Surface Hardness (HR 30T) | 74 | 80 |

Table 2-continued

| | Ultrasonic Wave-Irradiated Cans | Non-Irradiated Cans |
|---|---|---|
| Standard Deviation ($\sigma$) | 1.67 | 2.83 |
| Appearance | metallic luster on outer surface, no scratches and no voids | metallic luster on outer surface but number of scratches and voids being observed |
| Maximum Height Roughness (Hmax) | 0.4 $\mu$ | 0.8 $\mu$ |

From the results shown in Table 2, it will readily be understood that according to this invention seamless containers having excellent appearance characteristics and uniform thickness and surface hardness can be obtained.

EXAMPLE 2

Seamless can bodies were prepared in the same manner as described in Example 1 except that the number of strokes of the ironing punch was changed to 135/min. When the ironing was conducted under irradiation of ultrasonic waves according to this invention, none of 675 can bodies were broken even though the manufacturing rate was considerably high. In contrast, when no ultrasonic wave was irradiated, such troubles as breaking of the bottom end, breaking of the upper ear edge and breaking of the body wall were observed in 17 can bodies among 675 can bodies. Accordingly, it was confirmed that even under severe ironing conditions a highly improved lubricating effect can be obtained in this invention.

EXAMPLE 3

A rolled aluminum plate (soft 4S aluminum) having a thickness of 0.45 mm was blanked into discs having a diameter of about 122 mm, and they were formed into cup-like articles having an inner diameter of about 56 mm by using a drawing die and a drawing punch according to customary drawing and redrawing procedures.

Then, these cup-like formed articles were formed into can bodies in the same manner as in Example 1 except that the ironing ratio was changed as follows:

| Ironing Die | Ironing Ratio |
|---|---|
| first | 31 % |
| second | 29 % |
| third | 43 % |
| total (overall ironing ratio) | 72 % |

The dimensions and properties of seamless can bodies prepared in the above-mentioned manner according to this invention are shown in Table 3. For comparison, the dimensions and properties of seamless can bodies prepared in the same manner as above except that no ultrasonic vibration was irradiated are also shown in Table 3.

Table 3

| | Ultrasonic Wave-Irradiated Cans | Non-Irradiated Cans |
|---|---|---|
| Inner Diameter (mm) | 56 | 56 |
| Height (mm) | 130 − 130.5 | 130 − 131.5 |
| Thickness (mm) of | 0.125 ± 0.02 | 0.125 ± 0.06 |

Table 3-continued

| | Ultrasonic Wave-Irradiated Cans | Non-Irradiated Cans |
|---|---|---|
| Side Wall Portion | | |
| Average Surface Hardness (Hv 500 g) | 90.0 | 96.4 |
| Standard Deviation ($\sigma$) | 1.79 | 3.00 |
| Appearance | excellent | scratches and voids |
| Maximum Height Roughness (Hmax) | 0.6 $\mu$ | 1.0 $\mu$ |

EXAMPLE 4

Run:

A bright tin-plated steel plate (material formed by continuous casting; tin coating on the surface being 1.00 lb per base box) having a thickness of 0.32 mm was blanked into discs having a diameter of about 142 mm and they were formed into cup-like articles having an inner diameter of about 65 mm between a drawing punch and a drawing die according to customary procedures.

Then, the cup-like formed articles were ironed by using an ironing forming apparatus as shown in FIG. 6.

The lubricating operation was accomplished by spraying a lubricant having the following composition to cup-like formed articles to be processed from nozzles 33*a*, 33*b* and 33*c* disposed on the inlet sides of respective ironing dies.

| Composition of Lubricant: | |
|---|---|
| Mineral Oil | 3 parts |
| Surface Active Agent | 1 part |
| Water | 6 parts |

The angle of the tapered inlet portion 48 of each ironing die 24 was 8°, and ultrasonic wave-irradiating mechanism-supporting members 42 used had a form as shown in FIG. 7-A ( number of projections = 8, the size in the radial direction of the projection = 75 mm; the depth of the notch = 25 mm ). The supporting face 47 of the supporting member 42 was made in parallel with the tapered face of the tapered inlet portion 48 so that ultrasonic waves were irradiated perpendicular to the tapered face. The frequency and power ( the total power of 8 mechanisms ) of ultrasonic wave-irradiating mechanisms 43, 44 attached to respective supporting members were 15 – 20 KHZ and 500 W, respectively.

The ironing ratio attained by each ironing die was as shown below.

Table 4

| Ironing Die | Ironing Ratio (%) |
|---|---|
| first | 18.7 |
| second | 38.4 |
| third | 37.5 |
| total (overall ironing ratio) | 68.7 |

The stroke number per minute of the ironing punch 23, namely the rate of manufacturing ironed can bodies per minute, was 120 per minute.

The dimensions of the so ironed can bodies, the average surface hardness ( HR 30T and HV 500 g ) of the side wall portion, the standard deviation of the surface hardness, the surface appearance of the side wall portion and the smoothness of the side wall portion ( maximum height roughness Hmax ) were determined. Further, the elevation of the temperature of the lubricant was measured after the ironing operation had been continued for 10 minutes. These data were also obtained with respect to the following Comparative Runs. Results are shown in Table 5.

Run 2:

The ironing forming was conducted in the same manner as in Run 1 except that no ultrasonic wave was irradiated on either the ironing die 24 or the ironing punch 23.

Run 3:

The ironing forming was conducted in the same manner as in Run 1 except that an octagonal plate free of a notch was used as the ultrasonic wave-irradiating mechanism-supporting member 42.

Run 4:

The ironing forming was conducted in the same manner as in Run 1 except that the inclination of the supporting face 47 of the ultrasonic wave-irradiating mechanism-supporting member 42 was reversed so that the ultrasonic wave was irradiated substantially in parallel with the tapered inlet portion 48 of the ironing die.

Table 5

| | Run 1 | Run 2 | Run 3 | Run 4 |
|---|---|---|---|---|
| Inner diameter (mm) of cans | 65.30 ± 0.1 | 65.30 ± 0.5 | 65.30 ± 0.2 | 65.30 ± 0.2 |
| Height (mm) of cans | 122 – 123.5 | 122.5 – 130 | 122 – 125 | 122 –126.5 |
| Thickness (mm) of side wall | 0.10 ± 0.01 | 0.10 ± 0.05 | 0.10 ± 0.02 | 0.10 ± 0.03 |
| Average surface hardness (HR 30T) | 73 | 81 | 75.5 | 77 |
| Standard deviation ($\sigma$) | 1.64 | 2.85 | 1.71 | 1.85 |
| Appearance | metallic luster on outer surface, none of scratches or voids observed | metallic luster on outer surface but number of scratches and voids observed (some having cloudy luster) | metallic luster on outer surface but some number of scratches observed | metallic luster on outer surface but scratches observed (degree of formation scratches being intermediate between those observed in Runs 2 and 3) |
| Hmax ($\mu$) | below 0.4 | below 0.8 | below 0.5 | below 0.5 |
| Temperature elevation (°C.) | 4 – 5 | 10 – 13 | 5 – 7 | 6 – 7 |

From the results shown in Table 5, it will readily be understood that seamless can bodies excellent in the appearance characteristics and the uniformity of the plate thickness and surface hardness can be obtained without such troubles as excessive elevation of the temperature according to this invention.

EXAMPLE 5

Seamless can bodies were prepared in the same manner as in Run 1, 2, 3 or 4 of Example 4 except that the number of strokes of the ironing punch was changed to 150 per minute. The number of defective cans having such defects as breaking of the bottom end, breaking of the upper ear edge and breaking of the body wall among cans prepared by such high speed production was counted to obtain results shown in Table 6, where in the column of "Defective Cans " the denominator indicates the total number of manufactured cans and the numerator indicates the number of defective cans.

Table 6

| Run No. | Ultrasonic Wave Irradiation System | Defective Cans |
|---|---|---|
| 5 | Run 1 | 0/750 |
| 6 | non-irradiated (Run 2) | 16/746 |
| 7 | Run 3 | 2/738 |
| 8 | Run 4 | 5/751 |

From the results shown in Table 6, it will readily be understood that according to this invention a much better lubricating effect can be obtained even at a high manufacturing rate and under severe ironing conditions than in the conventional ironing forming method.

EXAMPLE 6

A rolled aluminum plate having a thickness of 0.45 mm ( soft 4S aluminum ) was blanked into discs having a diameter of 122 mm and they were subjected to the customary drawing and redrawing treatments by using a drawing die and a drawing punch in combination to obtain cuplike articles having an inner diameter of 56 mm.

Developed and ironed cans were prepared in the same manner as in Run 1, 2, 3 or 4 of Example 4 except that the ironing ratio was changed as shown below.

Table 7

| Ironing Die | Ironing Ratio (%) |
|---|---|
| first | 31 |
| second | 41 |
| third | 39 |
| total (overall ironing ratio) | 75.5 |

Results obtained in the above runs are shown in Table 8.

Table 8

| | Run 9 | Run 10 (non-irradiated) | Run 11 (corresponding to Run 3) | Run 12 (corresponding to Run 4) |
|---|---|---|---|---|
| Inner diameter (mm) of cans | 56 ± 0.15 | 56 ± 0.6 | 56 ± 0.3 | 56 ± 0.5 |
| Height (mm) of cans | 130 – 130.8 | 130 – 138 | 130 – 134.5 | 130 – 135 |
| Thickness (mm) of side wall | 0.11 ± 0.02 | 0.11 ± 0.07 | 0.11 ± 0.05 | 0.11 ± 0.04 |
| Average surface hardness (HV 500 g) | 91 | 98 | 93 | 93 |
| Standard deviation ($\sigma$) | 1.75 | 2.98 | 1.82 | 1.91 |
| Appearance | beautiful and excellent | full of scratches and voids | some of small scratches observed | degree of formation of scratches similar to that in Run 11 |
| Hmax ($\mu$) | below 0.5 | below 0.9 | below 0.6 | below 0.7 |
| Temperature elevation (°C.) | 4 | 10 | 6 | 6 – 7 |

What we claim is:

1. A process for the preparation of thin-walled cylindrical containers which comprises the steps of a. inserting an ironing punch having an outer peripheral surface into the interior of a cup-llke formed article composed of a metal material, said outer peripheral surface having a slip-fitting engagement with the inner face of the side wall portion of the cup-like formed article, b. engaging the side wall portion of the cuplike formed article supported by the ironing punch with a plurality of circular ironing dies disposed coaxially with the ironing punch thereby to elongate the side wall portion of the cup-like formed article and reduce the thickness of said side wall portion, c. lubricating the side wall portion of the cup-like formed article by feeding a liquid lubricant at least to the part of the side wall portion to be elongated in advance of engagement thereof by a respective one of the ironing dies, and d. simultaneously irradiating ultrasonic waves at least on said part of the side wall portion and thereby uniformly distributing the liquid lubricant on the side wall portion between the side wall portion being elongated and the associated ironing die.

2. A process according to claim 1 wherein the liquid lubricant is an aqueous emulsion of at least one lubricating component selected from the group consisting of mineral oils, plant oils, polysiloxanes and polyolefins formed by emulsifying said lubricating component at a concentration of 20% to 60% in water with a surface active agent.

3. A process according to claim 1 wherein ultrasonic waves having a frequency of 10 to 30 KHZ are irradiated.

4. A process according to claim 1 wherein ultrasonic waves having a power of 300 W to 1KW are irradiated.

5. A process according to claim 1 wherein ultrasonic waves are irradiated from a plurality of ultrasonic wave-generating mechanisms disposed around the circumference of the ironing die.

6. A process according to claim 1 wherein ultrasonic waves are irradiated from a ultrasonic wave-generating mechanism disposed in the axial direction of the ironing punch.

7. A process according to claim 1 wherein the ironing processing is conducted so that the ironing ratio defined by the following formula $$\text{ironing ratio} = \frac{\text{plate thickness before ironing-plate thickness after ironing}}{\text{plate thickness before ironing}} \times 100$$

is 20 to 60 % per stage of the ironing processing and the overall ironing ratio is 60 to 83 %.

8. A process for the preparation of thin walled cylindrical containers which comprises the steps of a. inserting an ironing punch having an outer peripheral surface into the interior of a cup-like formed article composed of a metal material, said outer peripheral surface having a slip-fitting engagement with the inner face of the side wall portion of the cup-like formed article, b. engaging the side wall portion of the cuplike formed article supported by the ironing punch with a plurality of circular ironing dies disposed coaxially with the ironing punch thereby to elongate the side wall portion of the cup-like formed article and reduce the thickness of said side wall portion, each of said circular ironing dies having a tapered inlet portion of the die, c. lubricating the side wall portion of the cup-like formed article by feeding a liquid lubricant at least to the part of the side wall portion to be elongated, and d. simultaneously irradiating ultrasonic waves at least on said part of the side wall portion from a plurality of ultrasonic wave-irradiating mechanisms disposed and distributed around the circumference of the ironing dies through a plurality of ultrasonic wave-irradiating mechanism-supporting members disposed equidistantly and substantially independently from one another around the circumference of said dies corresponding to each of said ultrasonic wave-irradiating mechanisms in the direction substantially perpendicular to the tapered inlet portion of the dies to uniformly distribute the liquid lubricant on the side wall portion between the side wall portion of respectives ones of said ironing dies.

9. A process according to claim 8 wherein a plurality of ultrasonic wave-irradiating mechanismsupporting members are equidistantly and substantially independently from one another around the circumference of the circular ironing die, a ultrasonic wave-irradiating mechanism comprising an assembly of a ultrasonic vibrator element and a horn is mounted on each of said supporting members, and ultrasonic waves are irradiated on the ironing die through said supporting members.

10. A process according to claim 8 wherein ultrasonic waves having a frequency of 10 to 30 KHZ are irradiated, the power of said ultrasonic waves being 300 W to 1 KW per ironing die.

11. A process according to claim 8 wherein the metal material is a black plate and the ironing processing is conducted so that the ironing ratio per stage of the ironing is 25 to 45 % and the overall ironing ratio is 56 to 70%.

12. A process according to claim 8 wherein the metal material is a soft aluminum plate and the ironing processing is conducted so that the ironing ratio per stage of the ironing is 40 to 48 % and the overall ironing ratio if 64 to 82%.

13. A process according to claim 8 wherein the metal material is a hard aluminum plate and the ironing processing is conducted so that the ironing ratio per stage of the ironing is 34 to 46 % and the overall ironing ratio is 64 to 78 %.

14. A process according to claim 8 wherein the metal material is a bright tin-plated steel plate and the ironing processing is conducted so that the ironing ratio per stage of the ironing is 35 to 45 % and the overall ironing ratio is 62 to 75 %.

15. A process according to claim 8 wherein the metal material is a matted tin-plated steel plate and the ironing processing is conducted so that the ironing ratio per stage of the ironing is 38 to 48 % and the overall ironing ratio is 62 to 78 %.

16. A process according to claim 8 wherein the tapered inlet portion of the ironing die is inclined with respect to the moving direction of the ironing punch with an angle of 5° to 20° and ultrasonic waves are irradiated substantially perpendicularly to said tapered inlet portion of the ironing die.

17. An apparatus for the production of thin walled cylindrical containers which comprises an ironing punch for supporting a cup-like formed article composed of a metal material, a plurality of circular ironing dies surrounding the axis of the ironing punch and engaged with the side wall portion of the cup-like formed article supported on the ironing punch, a driving mechanism for causing a relative reciprocal movement between said ironing punch and ironing dies, a lubricant feed mechanism disposed to feed a lubricant at least to the part of the side wall portion of the cup-like formed article to be ironed, and means for uniformly distributing the lubricant on the part of the side wall portion to be ironed and between the side wall part and said circular dies, said means including a plurality of ultrasonic wave-irradiating mechanism-supporting members disposed equidistantly and substantially independently from one another on the outer periphery of said circular dies, and a ultrasonic waveirradiating mechanism comprising an assembly of a ultrasonic vibrator element and a horn is disposed on each of said ultrasonic wave-irradiating mechanism-supporting mechanisms so that the axis of the ultrasonic wave-irradiating mechanism is substantially perpendicular to a tapered inlet portion of said ironing dies.

18. An apparatus as set forth in claim 17 wherein a plurality of said ultrasonic wave-irradiating mechanismsupporting members including a number of projections disposed around the peripheral portion of said ironing dies.

19. An apparatus as set forth in claim 17 wherein said ultrasonic wave-irradiating mechanism-supporting members are equidistantly arranged so that the circumferential angle between the two adjacent supporting members disposed on the outer periphery of a respective ironing die is 15° to 90°.

* * * * *